United States Patent [19]

Duchenois

[11] Patent Number: 4,647,810

[45] Date of Patent: Mar. 3, 1987

[54] DISPLAY DEVICE COMPRISING A SCREEN COOLING CIRCUIT

[75] Inventor: Valère D. L. Duchenois, Paris, France

[73] Assignee: U.S. Philips Corporation, New York, N.Y.

[21] Appl. No.: 625,378

[22] Filed: Jun. 27, 1984

[30] Foreign Application Priority Data

Jul. 6, 1983 [FR] France ..... 83 11269

[51] Int. Cl.[4] ..... H01J 7/26; H01J 29/89; H01J 29/18

[52] U.S. Cl. ..... 313/36; 313/44; 313/475; 313/478

[58] Field of Search ..... 313/475, 478, 477, 474, 313/44, 36, 372

[56] References Cited

U.S. PATENT DOCUMENTS 2,093,288 9/1937 Ogloblinsky ..... 313/478 X 3,585,432 6/1971 Oberg ..... 313/475

4,533,850 8/1985 Ohkoshi et al. ..... 313/36

*Primary Examiner*—Palmer C. DeMeo

*Attorney, Agent, or Firm*—F. Brice Faller

[57] ABSTRACT

A display device with a cooling circuit in the screen to limit the rise in temperature of the luminescent material, particularly during strong current densities of the electron beam. The device comprises a window formed of an optical fiber plate of which one or several cladding glasses have been partially removed in order to form channels for the passage of a cooling liquid while maintaining studs comprising light conductors formed by the glass core surrounded by a cladding glass of the optical fiber plate. A transparent display window having a luminescent layer is glued or sealed to the window thus constituting a cooling network connected to an external circulation by pipes embedded in moulding tubes.

13 Claims, 8 Drawing Figures

DISPLAY DEVICE COMPRISING A SCREEN COOLING CIRCUIT

BACKGROUND OF THE INVENTION

The present invention relates to a display device comprising an evacuated envelope having a display window with a display screen on its inner face and, in front of its outer face, which is substantially parallel to the display window, a second window having a good transparancy. A cooling fluid circulates between the display window and the second window, said windows being in contact in zones of the windows.

A display device, for example a display tube, comprising a window having a network of channels destined to ensure the circulation of cooling fluid is described in Netherlands Patent Application filed in the name of N. V. Philips' Gloeilampenfabrieken on Mar. 19, 1982 under No. 82 011 36. The window of said display tube is constituted by two glass plates connected together and having cooling means constituted by grooves in one of the plates. Said grooves may be obtained at the end of moulding or etching operations of one of the plates.

Said grooves provided parallel to one of the rectangular sides of the window of the display tube may have a cross section of a trapezoidal or sinusoidal shape. Said shape given to the grooves permits of eliminating the light losses by the lateral edges of the grooves. The cooling fluid has a refractive index which is equal to that of the glass constituting the plate comprising the grooves. The other plate may have a different refractive index, the assembly of said characteristics causing no distortion of the image whatsoever. The screen of such a display tube is generally constituted by a luminescent layer on which there is written by means of an electron beam. Under the influence of the electron bombardment the temperature of the screen increases such that a loss of luminous efficiency of the luminescent material occurs. This phenomenon makes itself felt in particular when the current densities of the electron beams are considerable, as in projection tubes for television. This phenomenon necessitates the cooling of the luminescent material.

In order that inequalities of the refractive index connected with thermal inhomogeneities and with turbulances are not going to distort the image, it is necessary to make arrangements to the inlet pipes and outlet pipes for the cooling liquid in the cooling chamber and to give the said cooling chamber such dimensions that the circulation of the cooling fluid in the said chamber is laminar. This is described in Netherlands Patent Application filed in the name of N. V. Philips' Gloeilampenfabrieken on the 13th of January 1983 under No. 83 001 14.

In all these cases inconveniences appear in the field of the optical realisation and cooling. In effect the geometrical dimensions of the grooves must be determined so that they are sufficiently small, with respect to the picture element, not to distort the picture and nevertheless sufficient to ensure the circulation of the cooling liquid.

The shape of the grooves, having a cross-section which is rectangular, triangular, sinusoidal or otherwise, must also be examined, as well as the state of the surface of the said grooves.

In practice, the index of the fluid also is not strictly equal to that of the glass constituting the place in which the grooves are provided and picture distortions occur if the flow of the fluid is not laminar or if there is a temperature gradient involving a variation of the refractive index.

SUMMARY OF THE INVENTION

An important advantage of the invention described hereinafter is that the paths followed by the light issued by the display screen do not substantially penetrate into the cooling liquid.

For that purpose, a display device of the type described in the opening paragraph is characterized according to the invention in that the contact zones are constituted by contact studs which have substantially the same height and which are disposed regularly at the surface of one of the windows on the face directed towards the other window, the contact studs extending substantially rectilinearly through the window on which they are provided, the contact studs and their extensions forming light conductors constituted by a glass core surrounded:

first, at the level of the said contact studs, either by a first material or by a cooling liquid both having a refractive index lower than that of the said glass core, second, on the whole of the said extensions, by the said first material, the light conductors being fixed together at the level of the said extensions either directly or by a second material and separated at the level of the contact studs by the said cooling liquid.

Since the cooling liquid is not traversed by the light destined to form the picture, it may hence have less delicate conditions of preparation than in the prior art in as far as the presence of dust, bubbles or other instabilities are concerned.

BRIEF FIGURE DESCRIPTION

The invention will be better understood with reference to the following description of a few modes of realising the invention, the said description being accompanied by drawings, in which.

DETAILED DISCLOSURE OF THE INVENTION

Figure 1:
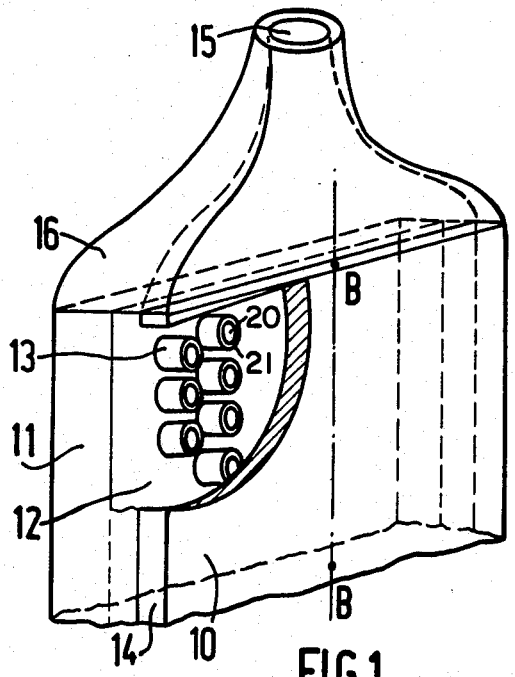
FIG. 1 is a perspective diagrammatic view partly broken away of the two windows of the display device according to a first embodiment.
Figure 2:
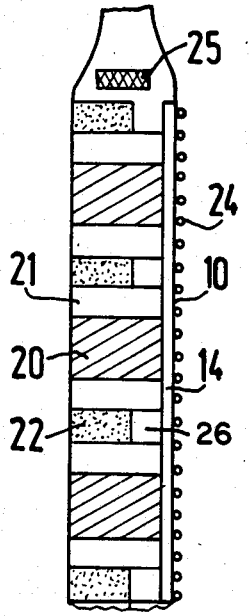
FIG. 2 is a partial sectional view of a first embodiment of the two sealed windows of the display device along a plane perpendicular to the inner face 10 passing through the axis BB.
Figure 4:
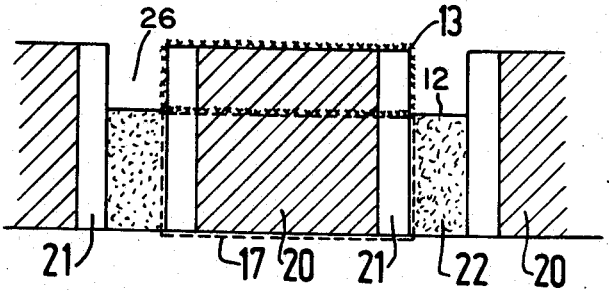
FIG. 4 is a partial view of a first embodiment, on a scale double that of the preceding one, along the same cross-section as in FIG. 3 of the optical fiber plate constituting the second window after the treatment of chemical attack of the second material.
Figure 3:
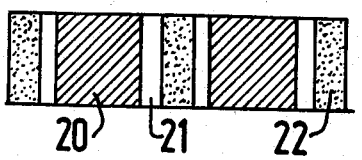
FIG. 3 is a partial view along the same section as in FIG. 2 of a first embodiment of the plate of optical fibers constituting the second window before attack of the second material.
Figure 5:
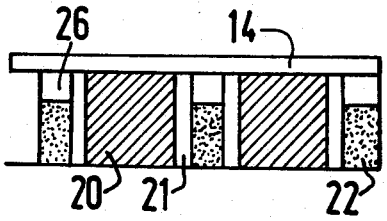
FIG. 5 is a partial view on the same scale and according to the same cross-section as in FIG. 3 of a first embodiment after chemical attack of the second material and after the assembly of the display window.
Figure 6:
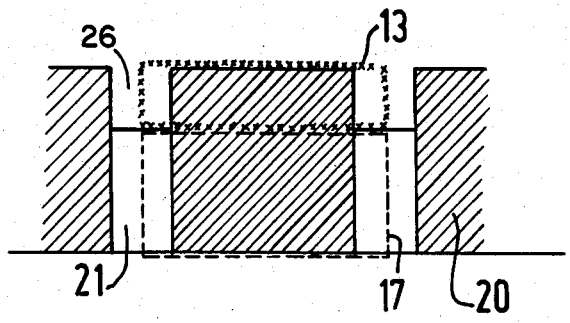
FIG. 6 is a sectional view similar to that of FIG. 4 of a first embodiment but in the case where the second material is not present.
Figure 7:
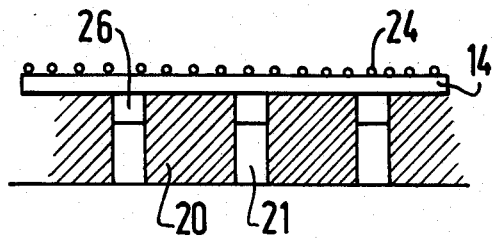
FIG. 7 is a cross-section similar to that of FIG. 5 of a first embodiment but in the case where the second material is not present.

According to a first embodiment (FIGS. 1 to 7) the present invention relates to a display device, for example a display tube having a display screen 24, in which the second window 11 which has the contact studs 13 is an optical fiber plate having parallel and optically polished faces. It is known that an optical fiber plate is comprised of a plurality of mutually parallel glass fibers having a high refractive index which are embedded in one or several other glasses having a lower index, termed cladding glass (FIG. 3), constituting the first and second materials 21 and 22 in this embodiment and permitting the propagation of the light by the mechanism of total reflection appearing at the level of the contact of the glass core 20 and of the cladding glass 21, element by element, without crosstalk between them. It is also known that the glasses constituting the optical fiber have different chemical compositions. It is hence possible, due to a suitable choice of the chemical agents, to attack and dissolve, at will, either one or several cladding glasses, or the glass core.

One of the objects of the invention is to realise the network of channels serving for the circulation of a cooling fluid by dissolving partially, by a chemical agent, one or several cladding glasses while preserving the glass core. A support for the optical fibre plates is then obtained, FIGS. 1 to 5, constituting the second window 11 having on one of its faces 12 a plurality of small contact studs 13 constituted by the glass core 20 surrounded or not by one or several cladding glasses 21, 22, which contact studs have been made so as to project after dissolving one or several of the cladding glasses. This operation is carried out after the edges and one of the faces of the support have been protected by a paint or a resin before the chemical attack, the paint or the resin being then removed.

In the case (FIG. 6) where the second material 22 is not present, the first material 21 is constituted by the cladding glass which is dissolved over the whole height of the contact studs 13, and the space thus liberated constitutes the cooling chamber 26 where the cooling fluid circulates. Nevertheless a small loss of light may occur in the contact zone between the glass core and the cooling liquid, in which it may be that the cooling liquid does not behave in a manner which is as efficacious as the cladding glass itself for total reflection to occur.

In the case (FIG. 4) where the first and second materials 21, 22 are two different cladding glasses, the one which is nearest to the glass core is preserved over the whole of the height of the contact studs 13 in order that the lateral light losses become very small, the cooling chamber 26 being hence constituted by the space left free after partial dissolution, according to the invention, of the second material 22. So the first material 21 is constituted by the cladding glass nearest to the glass core and the second material 22 is constituted by the or the other cladding glasses.

Said contact studs 13 thus will serve for fixing the display window 14, the dense and regular distribution of the said contact studs 13 ensures a very good mechanical behaviour of the display window 14, the thickness of which may thus be reduced while correctly withstanding the pressure forces due to the existance of a low pressure in the display tube itself.

The display window 14 is sealed or glued to the second window 11 with the intermediary of the contact studs 13 and receives the luminescent material constituting its display screen 24 on the inner face 10 opposite its outer of glued face. The display window 14 may be constituted by a thin glass plate, a crystal plate or even a thin optical fiber plate, each bringing in its particular optical qualities, thermal conductivity, optical resolution.

The cooling chamber 26 thus constituted between the two windows 11, 14 and between the studs 13 is provided at two ends with an inlet pipe 15 and a similar outlet pipe for the cooling liquid, the edges of the two windows thus united are provided with a moulding 16 through which the pipes extend and which ensures the tightness on the whole periphery of the contact between the two windows. A flow divider system 25 ensures the distribution of the cooling liquid to the two extremities according to the desired flow characteristics.

A desired but non-limiting particularity is that the other cladding glasses have dissolution characteristics such that they may easily be attacked by the most currently used chemical agents, for example, compounds on the basis of hydrochloric acid for glasses rich in barium or lanthanum and strong bases (sodium or potassium) in a manner as to isolate the glasses rich in silica.

Figure 8:
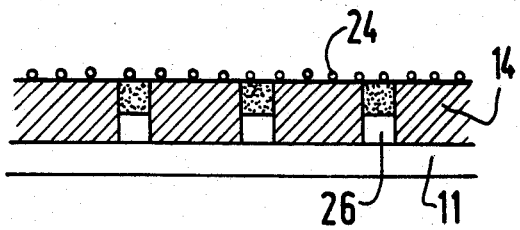
FIG. 8 is a sectional view according to the same plane as above of the display window and of the second sealed window in the case where the contact studs are supported by the display window.

According to a second embodiment (FIG. 8) of the invention the contact studs are imbedded in the display window 14 which receives the luminescent material. In order to ensure an efficacious cooling of the luminescent material according to the invention it is necessary that the display window 14 should be made thin between the contact studs. The mechanical resistance of the assembly constituted by the two united windows is connected with the distribution of the contact studs according to the invention and with the use, for the second window 11, of a thickness greater than that of the display window 14 in the first embodiment in order that the total qualities of resistance to the pressure forces are preserved.

According to a third embodiment of the invention the light conductors constituted by optical fiber elements are fixed together by the second material 22 which may be different from those already mentioned, for example, a known composite material such as a resin charged with a substance chosen for its properties of good thermal conductivity and/or its properties of mechanical resistance, and/or its properties associated with the characteristics of the coefficient of expansion adapted for sealing the display device in applications according to the invention.

In the third embodiment the second window 11 constituted by an optical fiber plate is attacked on the face which is not opposite to the display window 14, using the same process and means as in the first and second embodiments. So one or several of the cladding glasses, of the slice of optical fibers is removed to a desired depth. By a known moulding process the removed cladding glass or glasses are replaced, for example by a material having the desired properties, for example a thermally conductive resin. The face thus restored is polished to provide the necessary optical qualities. Steps are then carried out to form the contact studs on the face opposite to the other window according to the method described in the first embodiment. The importance of this third embodiment is to replace the cladding glass constituting the second material of the first optical fibre plate by a composite material giving it new properties as regards, for example, its facility of sealing, its thermal conductivity and/or its mechanical resistance.

The necessity of cooling of the luminescent material presents itself in the case where the electric power of the electron beam is such that a substantial heating of the said luminescent material is produced. This is the case for display devices such as:

A display tube in the case where the electric power dissipated over the screen becomes important, or more currently in projection tubes which necessitate an important electrical power dissipated over the screen, or even in display devices having flat screens of a large surface area using the mechanism of gas discharge, usually termed devices having a flat screen.

What is claimed is:

1. In a display device comprising an evacuated envelope having a display window with an inner face and an outer face, said display window having a display screen on said inner face, a second transparent window spaced from said outer face, the second window being substantially parallel to said display window, and spacing means defining a chamber between said windows for enabling a cooling liquid to circulate between said display window and second window; the improvement wherein said spacing means comprises a plurality of spaced apart light conductors extending between and perpendicular to and contacting said display window and second window, said light conductors being surrounded by one material having a lower refractive index than that of said light conductors, at least a portion of the space between said light conductors defining said chamber.

2. The display device of claim 1 wherein said light conductors comprise glass cores.

3. The display device of claim 2 wherein said one material is glass.

4. The display device of claim 1 wherein said cores are surrounded by sheaths of said one material throughout their lengths, and further comprising a second material interconnecting said sheaths throughout only a portion of their lengths, to define said chamber.

5. The display device of claim 4 wherein said chamber is adjacent to one of said windows.

6. The display device of claim 1 wherein said one material defines sheaths surrounding said cores for only a part of their respective lengths, said cooling liquid having a lower refractive index than that of said cores and being in contact with the remainder of the lengths of said cores.

7. The display device of claim 6 wherein said chamber is adjacent one of said windows.

8. The display device of claim 1 wherein said light conductors are optical fibers.

9. The display device of claim 1 wherein said display screen is a luminescent layer.

10. The display device of claim 1 wherein said spacing means comprises an optical fiber plate having flate parallel surfaces.

11. The display device of claim 1 wherein said display window is a glass sheet.

12. A display device as in claim 1 wherein said light conductors extend through said second transparent window.

13. A display device as in claim 12 wherein said one material extends through said second transparent window.

* * * * *